US007958734B2

(12) United States Patent
Paprotna et al.

(10) Patent No.: US 7,958,734 B2
(45) Date of Patent: Jun. 14, 2011

(54) COVER ASSEMBLY FOR GAS TURBINE ENGINE ROTOR

(75) Inventors: Hubertus E. Paprotna, Palm City, FL (US); Richard Colin Charron, West Palm Beach, FL (US); Jody W. Wilson, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 12/564,194

(22) Filed: Sep. 22, 2009

(65) Prior Publication Data

US 2011/0070078 A1 Mar. 24, 2011

(51) Int. Cl.
*F23R 3/14* (2006.01)

(52) U.S. Cl. ..... 60/800; 60/39.37

(58) Field of Classification Search ..... 60/752, 60/796, 798, 799, 800, 39.37, 804, 269
See application file for complete search history.

(56) References Cited

U.S. PATENT DOCUMENTS

| | | | | | |
|---|---|---|---|---|---|
| 972,642 | A * | 10/1910 | Reed | 60/793 |
| 2,851,853 | A * | 9/1958 | Quick | 60/262 |
| 3,238,718 | A * | 3/1966 | Hill | 60/39.37 |
| 4,356,698 | A * | 11/1982 | Chamberlain | 60/733 |
| 2006/0225430 | A1 | 10/2006 | Paprotna et al. | |
| 2006/0288707 | A1 | 12/2006 | Weaver et al. | |
| 2007/0017225 | A1 | 1/2007 | Bancalari et al. | |

OTHER PUBLICATIONS

U.S. Appl. No. 11/498,479, filed Aug. 3, 2006 entitled "At Least One Combustion Apparatus and Duct Structure for a Gas Turbine Engine".
U.S. Appl. No. 11/498,480, filed Aug. 3, 2006 entitled "An Axially Staged Combustion System for a Gas Turbine Engine".
U.S. Appl. No. 12/420,149, filed Apr. 8, 2009 entitled "Modular Transvane Assembly".

* cited by examiner

*Primary Examiner* — Michael Cuff
*Assistant Examiner* — Vikansha S Dwivedi

(57) ABSTRACT

A cover assembly disposed about a rotor in a gas turbine engine. The cover assembly comprises a first cover, a second cover, and securing structure. The first cover is disposed about the rotor and comprises a forward end and an opposed aft end. The first cover is associated with a case mounting structure that is fixed to an engine casing. The second cover is disposed about the rotor and comprises a forward end and an opposed aft end. At least a portion of the first cover is disposed radially outwardly from the second cover. The securing structure couples the first cover to the second cover and permits relative radial movement between the first and second covers.

20 Claims, 4 Drawing Sheets

COVER ASSEMBLY FOR GAS TURBINE ENGINE ROTOR

FIELD OF THE INVENTION

The present invention relates to a rotor cover assembly in a gas turbine engine, and more particularly, to a rotor cover assembly that limits leakage between a hot gas path and one or more cooled areas proximate to the rotor cover assembly.

BACKGROUND OF THE INVENTION

In gas turbine engines, compressed air discharged from a compressor section and fuel introduced from a source of fuel are mixed together and burned in a combustion section, creating combustion products defining hot working gases. The working gases are directed through a hot gas path in a turbine section, where they expand to provide rotation of a turbine rotor. The turbine rotor may be linked to an electric generator, wherein the rotation of the turbine rotor can be used to produce electricity in the generator.

In view of high pressure ratios and high engine firing temperatures implemented in modern engines, it is important to limit leakage between the working gases in the hot gas path and cooling fluid in cooled areas in the engine to maximize performance and efficiency of the engine.

SUMMARY OF THE INVENTION

In accordance with a first aspect of the present invention, a cover assembly disposed about a rotor in a gas turbine engine is provided. The cover assembly comprises a first cover, a second cover, and securing structure. The first cover is disposed about the rotor and comprises a forward end and an opposed aft end. The first cover is associated with a case mounting structure that is fixed to an engine casing. The second cover is disposed about the rotor and comprises a forward end and an opposed aft end. At least a portion of the first cover is disposed radially outwardly from the second cover. The securing structure couples the first cover to the second cover and permits relative radial movement between the first and second covers.

The cover assembly may further comprise a flow directing duct adapted to alter a direction of working gases flowing between a combustor section of the engine and a turbine section of the engine.

The flow directing duct may be coupled to the first and second covers, and the first cover may be movable radially independently of the second cover and the flow directing duct.

The first cover, second cover, and flow directing duct may be movable axially substantially together.

The flow directing duct may be mounted to a vane carrier structure such that the flow directing duct is movable radially independently of the vane carrier structure and is movable axially with the vane carrier structure, the vane carrier structure mounted to the engine casing.

The securing structure may comprise a plurality of bolts, wherein a plurality of apertures are formed in a radially extending section of the first cover that receive the bolts. The apertures may comprise radial openings that are larger than diameters of corresponding ones of the bolts such that the first cover is permitted to move radially with respect to the bolts.

A first gap may be formed between the first and second covers, the first gap receiving cooling air that cools the first and second covers.

The second cover may include at least one bore formed therein, at least a portion of the cooling air in the first gap passes through the bore into a second gap between the second cover and the rotor, the cooling air in the second gap cools the second cover and the rotor.

The cover assembly may further comprise at least one sealing structure between the first and second covers, the sealing structure limiting leakage between the first gap and a hot gas path associated with the turbine section of the engine.

In accordance with a second aspect of the present invention, a cover assembly disposed about a rotor in a gas turbine engine is provided. The cover assembly comprises a first cover disposed about the rotor and comprising a forward end and an opposed aft end. The first cover is associated with a case mounting structure that is mounted to an engine casing. The cover assembly further comprises coupling structure that couples the first cover to the case mounting structure such that the first cover can move axially independently from the case mounting structure and the engine casing.

In accordance with a third aspect of the present invention, a cover assembly associated with a rotor in a gas turbine engine is provided. The cover assembly comprises an outer cover, an inner cover, a flow directing duct, securing structure, and coupling structure. The outer cover is disposed about the rotor and comprises a forward end and an opposed aft end. The outer cover is associated with a case mounting structure that is mounted to an engine casing. The inner cover is disposed about the rotor and comprises a forward end and an opposed aft end, at least a portion of the outer cover disposed radially outwardly from the inner cover. The flow directing duct is adapted to alter a direction of working gases flowing between a combustion section of the engine and a turbine section of the engine. The securing structure couples the first cover, the second cover, and the flow directing duct together. The securing structure permits the outer cover to move radially independently of the inner cover and the flow directing duct. The coupling structure couples the outer cover to the case mounting structure such that the cover assembly can move axially relative to the case mounting structure and the engine casing.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1A:
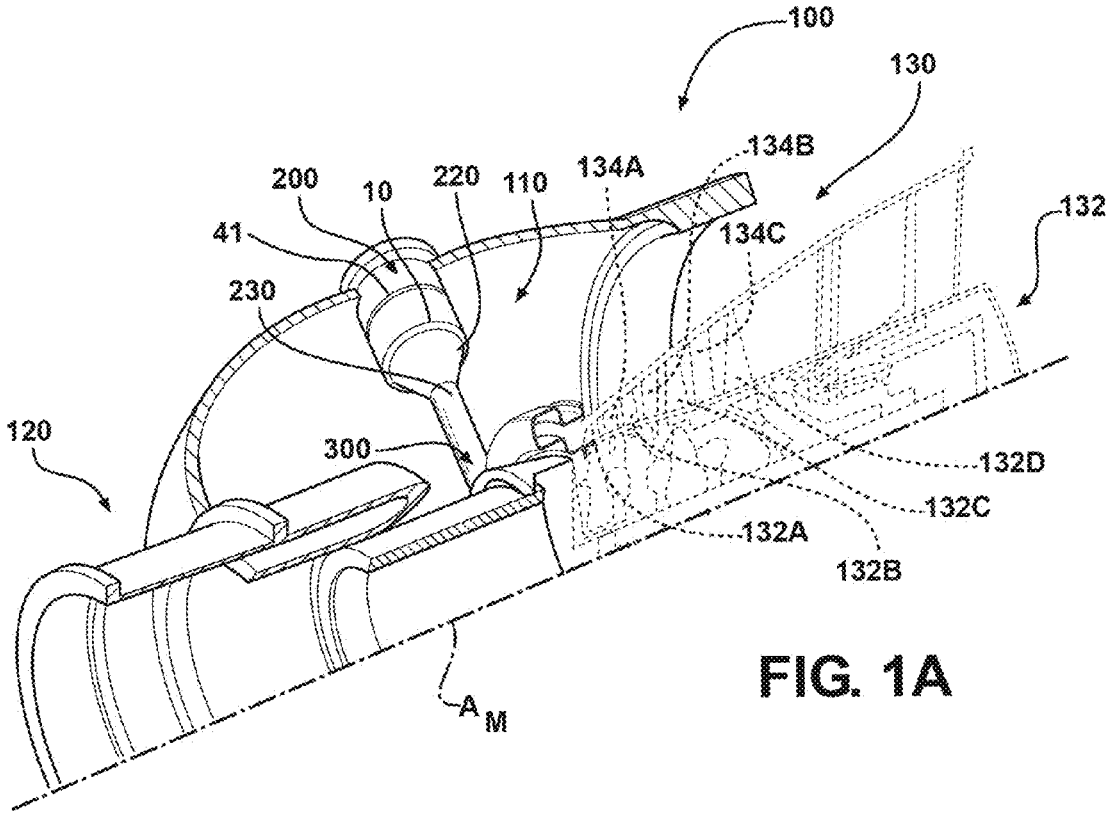
FIG. 1A is a sectional view of a gas turbine engine according to an embodiment of the invention.

Referring now to FIG. 1A, a gas turbine engine 100 is illustrated including a combustor section 110 formed in accordance with the present invention. The engine 100 further includes a conventional compressor section 120 for compressing air. The combustor section 110 produces expanding hot combustion products or gases by burning fuel in the presence of the compressed air produced by the compressor section 120. The engine 100 also includes a turbine section 130 comprising first, second, third and fourth axially spaced apart row blade assemblies 132A-132D coupled to a rotor 132 for receiving the expanding hot combustion products produced in the combustor section 110. The expanding hot combustion products impinge upon the blade assemblies 132A-132D to effect rotation of the rotor 132. The turbine section 130 further comprises second, third and fourth stationary row vane assemblies 134A-134C for directing the combustion products onto the second, third and fourth blade assemblies 132B-132D. The second vane assembly 134A is located between the first and second blade assemblies 132A and 132B, the third vane assembly 134B is located between the second and third blade assemblies 132B and 132C, and the fourth vane assembly 134C is located between the third and fourth blade assemblies 132C and 132D. In the illustrated embodiment, a vane assembly, i.e., a first vane assembly, is not provided between the combustor section 110 and the first blade assembly 132A.

In the illustrated embodiment, the combustor section 110 comprises a plurality of combustion apparatuses 200 and a duct structure 300. Each combustion apparatus 200, see FIGS. 1A and 1B, comprises a combustor device 10 to receive fuel and air, ignite at least a portion of the fuel and air and output a stream of first combustion products and any remaining fuel and air. Each combustion apparatus 200 further comprises a nozzle 220 coupled to a corresponding combustor device 10 for receiving and accelerating the first combustion products and any remaining fuel and air from the combustor device 10 in a direction generally normal to a machine axis $A_M$ of the gas turbine engine 100, see FIG. 1A. In the illustrated embodiment, each nozzle 220 comprises a cone, but could comprise any structure which performs an accelerating function. Each combustion apparatus 200 also comprises a tube 230, also, referred to herein as a transition element, coupled to and positioned between a corresponding nozzle 220 and a flow directing duct 310 functioning as a combination transition duct and first row vane forming part of the duct structure 300, see FIG. 1B. Each tube 230 has an internal bore with a substantially constant cross-sectional area along its length. Each tube 230 is coupled to the flow directing duct 310 so as to communicate with a corresponding entrance 314 in the flow directing duct 310 to allow the first combustion products and any remaining fuel and air from a corresponding nozzle 220 to pass into a first annular inner cavity 312A of the flow directing duct 310, see FIG. 1B.

Figure 1B:
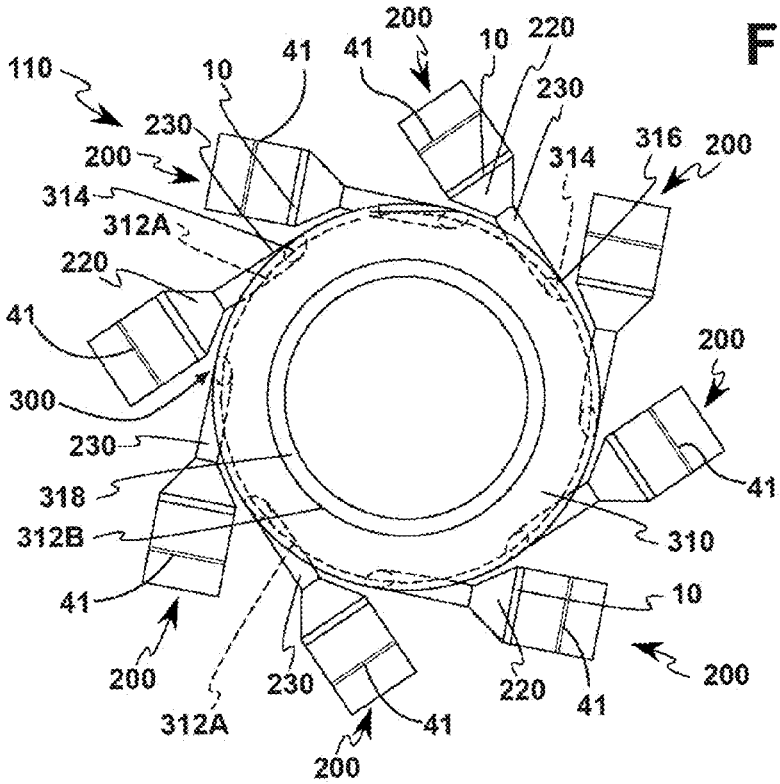
FIG. 1B is an exit side view of a combustor device of the gas turbine engine illustrated in FIG. 1A.

The duct structure 300 receives the first combustion products and any remaining fuel and air from the tubes 230 of the combustion apparatuses 200, allows any remaining fuel and air to combust to generate second combustion products, accelerates the first and second combustion products and outputs the first and second combustion products to the first row blade assembly 132A to effect rotation of the rotor 132, see FIGS. 1A and 1B.

As noted above, the duct structure 300 comprises the duct or flow directing duct 310. The flow directing duct 310 comprises the first annular inner cavity 312A and a second inner cavity 312B, which communicate with one another, see FIG. 2. The flow directing duct 310 further comprises a plurality of the entrances 314, which extend from an outer periphery 316 of the flow directing duct 310 into the first inner cavity 312A, and an annular exit 318, which communicates with the second inner cavity 312B, see FIGS. 1B and 2. The cross sections of the first and second inner cavities 312A and 312B allow the flow directing duct 310 to impart momentum in a direction substantially parallel to the machine axis $A_M$ to the first and second combustion products as they pass through the flow directing duct 310.

A similar combustor section comprising a plurality of combustion apparatuses and a duct structure is described in commonly owned U.S. patent application Ser. No. 11/498,479, entitled "At Least One Combustion Apparatus and Duct Structure for a Gas Turbine Engine," by Robert Bland and filed on Aug. 3, 2006, the entire disclosure of which is hereby incorporated by reference herein. In an alternate embodiment, the combustor section may comprise a plurality of combustion apparatuses and a duct structure, such as that described in commonly owned U.S. patent application Ser. No. 12/420,149, entitled "Modular Transvane Assembly," by Jody W. Wilson et al. and filed on Apr. 8, 2009, the entire disclosure of which is hereby incorporated by reference herein.

Figure 2:
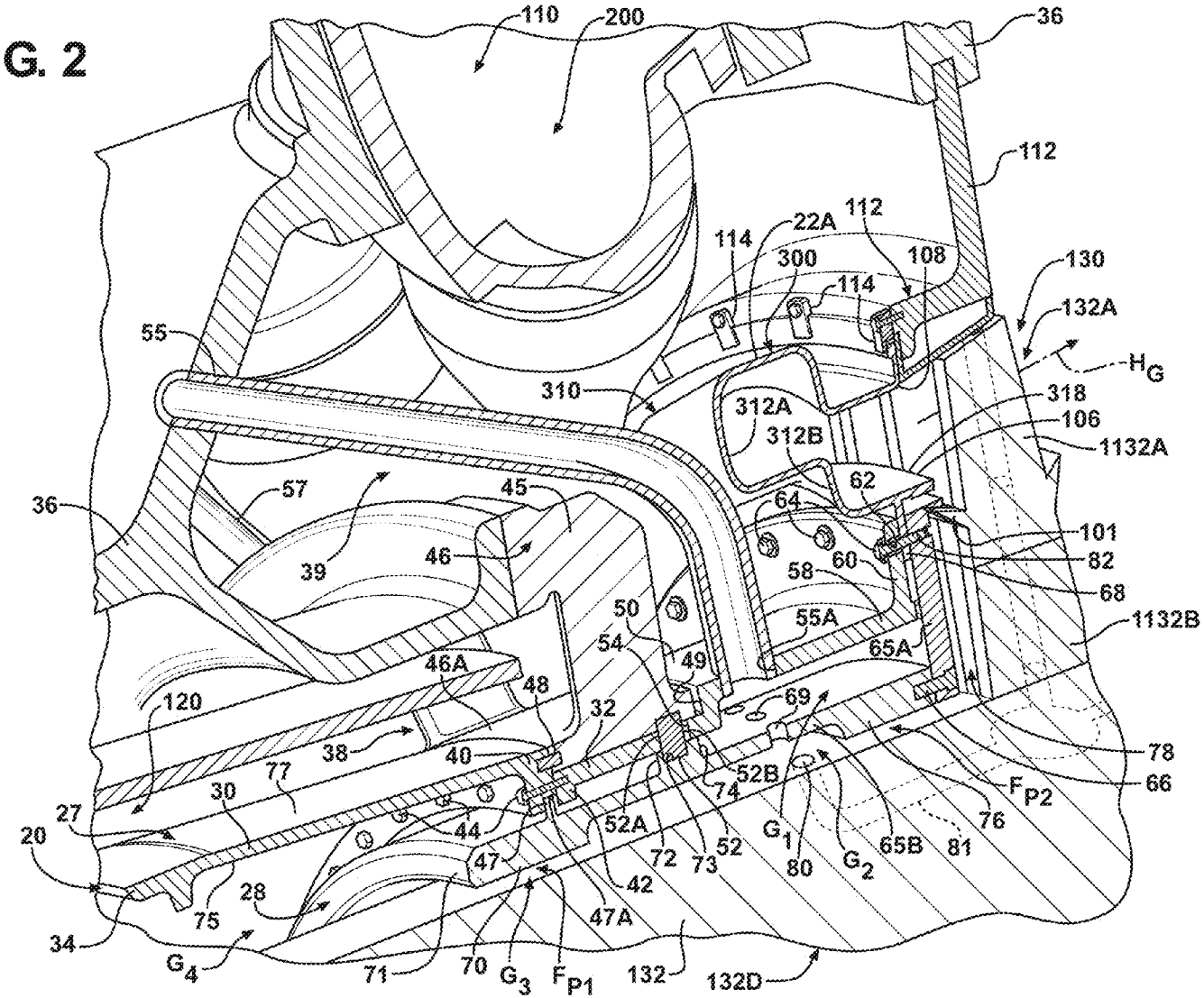
FIG. 2 is a perspective view partially in section of a transition section and portions of a combustion section and a turbine section and including a rotor cover assembly included in the gas turbine engine illustrated in FIG. 1A.

Referring now to FIG. 2, the combustor section 110 further comprises a rotor cover assembly 20. The rotor cover assembly 20 surrounds a portion 132D of the rotor 132 extending through the combustor section 110. The rotor 132 also extends into the compressor section 120 and the turbine section 130 of the engine. In an embodiment, components of the rotor cover assembly 20 may each comprise two halves or sections that are joined together about the rotor 132, such as, for example, by welding, although it is understood that the components may be formed from additional or fewer pieces/sections.

The rotor cover assembly 20 comprises in the illustrated embodiment an outer cover 27 and an inner cover 28, both of which are formed from a heat tolerant material, such as, for example, carbon steel, and both of which comprise generally cylindrical members that surround the rotor 132. The outer cover 27 illustrated in FIG. 2 comprises a first generally cylindrical member or portion 30 and a second generally cylindrical member or portion 32 that is axially downstream from the first portion 30. In the embodiment shown, the entire second portion 32 and at least part of the first portion 30 are located radially outwardly from the inner cover 28.

A forward end 34 of the outer cover first portion 30 is suspended radially outwardly from the rotor 132 and may include a seal assembly (not shown) to create a substantially fluid tight seal with the rotor 132. The seal assembly may include a rotating structure, such as a knife edge seal, coupled to the rotor 132 and/or a non-rotating seal structure, such as a honeycomb seal, coupled to the forward end 34 of the outer cover first portion 30. The first portion 30 and an engine casing 36 form a compressor section exit diffuser 38 that slows air that is compressed in the compressor section 120 to a desired speed before the compressed air reaches the combustion apparatuses 200, by providing an increased volume for the flow of air on its way to the combustion apparatuses 200. That is, as the compressed air flows axially from the compressor section 120 toward the combustion apparatuses 200, i.e., from the forward end 34 of the outer cover first portion 30 toward an aft end 40 of the outer cover first portion 30, a volume of the compressor section exit diffuser 38 increases, thus slowing the air down. Once through the exit diffuser 38, the air enters a combustor plenum 39 and thereafter enters each of the combustion apparatuses 200 through a respective annular opening 41 associated with each the combustion apparatus 200, although other suitable structure may be included for introducing the air into the combustion apparatuses 202, e.g., apertures formed in a flow sleeve (not shown) of each of the combustion apparatuses 200. It is noted that the compressed air flowing to the combustor section 110 may have a temperature of about 600° F.

The aft end 40 of the outer cover first portion 30 is fixed to a forward end 42 of the outer cover second portion 32, e.g., via bolts 44. The aft end 40 is also associated with a case mounting structure 46, which mounting structure 46 comprises a generally cylindrical base 46A and a plurality of arm members 45 integral with and extending radially outwardly from the generally cylindrical base 46A. The case mounting structure 46 is fixed to the engine casing 36 via the arm members 45. A plurality of coupling structures 48 are used to couple the outer cover first portion aft end 40 to the generally cylindrical base portion 46A of the case mounting structure 46. The coupling structures 48 permit an amount of relative axial movement between the outer cover 27 and the case mounting structure 46, yet prevent radial and circumferential movement between the outer cover 27 and the case mounting structure 46. For example, the coupling structures 48 may be codder pins that provide radial and circumferential support while allowing relative axial movement between the outer cover 27 and the case mounting structure 46. It is noted that other suitable coupling structures may be employed so long as the outer cover 27 is sufficiently supported about the rotor 132 while permitting an amount of axial movement between the outer cover 27 and the case mounting structure 46.

As shown in FIG. 2, a radial rib 47 extends from the inner cover 28 into a notch 47A defined by the outer cover first and second portions 30, 32. The radial rib 47 couples the inner cover 28 to the outer cover 27, yet allows a small amount of relative radial movement between the inner cover 28 and the outer cover 27, i.e., the radial rib 47 may radially slide within the notch 47A. Further, the notch 47A may be slightly oversized in the axial direction to allow for a slight amount of axial movement between the outer and inner covers 27, 28, i.e., to accommodate differences in thermal growth between the outer and inner covers 27, 28, as will be discussed in more detail herein.

As shown in FIG. 2, the mounting structure cylindrical base 46A is received in a recess 49 defined by the outer cover first and second portions 30 and 32. The recess 49 is axially longer than an axial length of the mounting structure base 46A to allow for relative axial movement between the case mounting structure 46 and the outer cover 27, as will be described in greater detail herein. A plurality of radially extending support members 52 are fixed to and extend inwardly from the mounting structure cylindrical base 46A and further extend through axially oversized apertures 54 formed in the outer cover second portion 32. The axially oversized apertures 54 permit the outer cover second portion 32 to move axially a small amount relative to the case mounting structure 46 before engaging the support members 52.

A plurality of cooling air feed tubes 55 (one shown in FIG. 2) deliver cooling fluid, e.g., air, from a cooling means (not shown) such as a heat exchanging element, through respective apertures 55A formed in the outer cover second portion 32. The cooling air feed tubes 55 deliver the cooling air into a first gap $G_1$ formed between the outer cover second portion 32 and the inner cover 28. The cooling air, which may have a temperature of between about 250-350° F., is used to cool the inner cover 28, the rotor 132, structure in the turbine section 130, and portions of the outer cover 27, as will be described in greater detail herein. A plurality of outlet tubes 57 (one shown in FIG. 2) communicating with the combustor plenum 39 provide a passage for compressed air to flow to the cooling means where the compressed air can be cooled and submitted into the first gap $G_1$ via the cooling air feed tubes 55.

Figure 3:
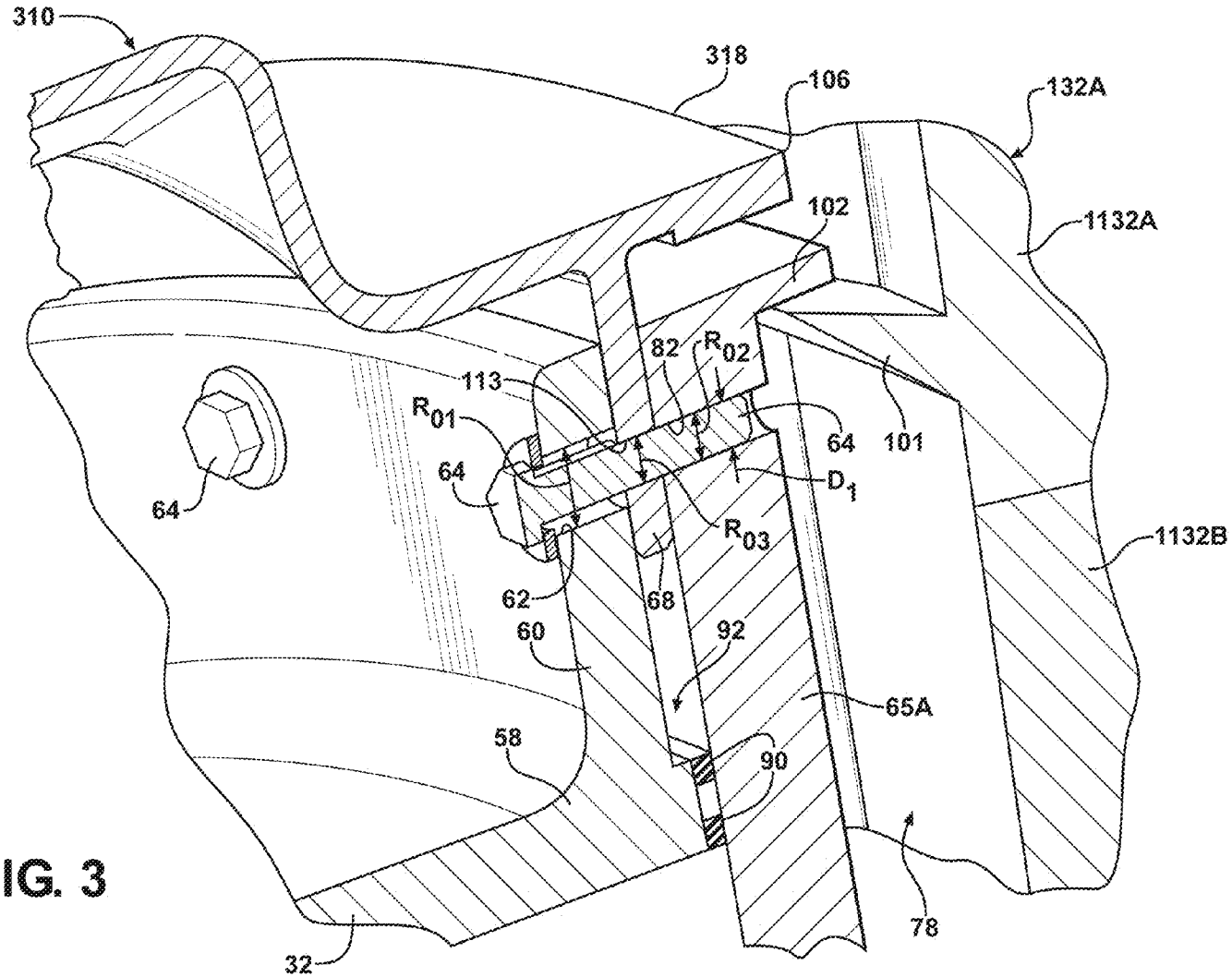
FIG. 3 is an enlarged perspective view partially in section of an aft end portion of the rotor cover assembly illustrated in FIG. 2.

As shown in FIGS. 2 and 3, an aft end 58 of the outer cover second portion 32 includes a radially outwardly extending section 60 that comprises a plurality of apertures 62 formed therein. The apertures 62 each comprise a radial opening $R_{O1}$ that is larger than a diameter $D_1$ of a plurality of bolts 64, see FIG. 3, or other suitable securing structures that are disposed in the respective apertures 62. It is noted that circumferential openings of the apertures 62 may be about the same size as the diameters $D_1$ of the bolts 64, such that the position of the outer cover second portion 32 relative to the inner cover 28 is circumferentially secured by the bolts 64. The bolts 64 are used to couple the section 60 of the outer cover second portion 32 to a radially outwardly extending section 65A of the inner cover 28. The inner cover 28 further comprises an axially extending section 65B, which is fixed to the radially extending section 65A via bolts 66, which bolts 66 radially support the axially extending section 65B of the inner cover 28, i.e., such that the inner cover 28 does not drop onto the rotor 132. The bolts 64 also couple the section 60 of the outer cover second portion 32 and the section 65A of the inner cover 28 to a radially inwardly extending support structure 68 of the flow directing duct 310, as will be described in greater detail herein.

Referring to FIG. 2, the radially inwardly extending support members 52 are received in a recess 73 defined by first and second protuberances 72, 74 that extend radially outwardly from and extend circumferentially about the inner cover axially extending section 65B. The first and second protuberances 72, 74 act as stops, i.e., contact axially facing sides 52A, 52B of the support members 52, to maintain the inner cover 28 in a desired axial position or within a small axial position range relative to the case mounting structure 46, as will be described in greater detail herein. It is noted that the first and second protuberances 72, 74 may extend circumferentially around all or only a portion of the support members 52 so as to prevent circumferential movement between the cover assembly 20 and the case mounting structure 46.

A plurality of bores 69 formed in the inner cover 28 allow the cooling air located in the first gap $G_1$, i.e., from the cooling air feed tubes 55, to flow into a second gap $G_2$ formed between the inner cover 28 and the rotor 132. The cooling air in the second gap $G_2$ effects cooling of the inner cover 28 and the rotor 132.

A first radially inwardly extending portion 70 of a forward end 71 of the inner cover axially extending section 65B comes into close proximity with the rotor 132. The close proximity between the first portion 70 and the rotor 132 defines a third gap $G_3$, which gap $G_3$ defines a first flow path $FP_1$, an axially upstream flow path, having a reduced radial dimension. A small amount of cooling air in the second gap $G_2$ is permitted to flow through the first flow path $FP_1$ and into a fourth gap $G_4$, which fourth gap $G_4$ is formed between the outer cover first portion 30 and the rotor 132. The cooling air in the fourth gap $G_4$ effects cooling of a radially inner side 75 of the outer cover first portion 30 and the rotor 132. However, a radially outer side 77 of the outer cover first portion 30 is exposed to the compressed air flowing through the exit diffuser 38 on its way to the combustion apparatuses 200, which compressed air is considerably hotter than the cooling air provided by the cooling air feed tubes 55, i.e., about 600° F. for the compressed air vs. between about 250-350° F. for the cooling air.

As shown in FIG. 2, a second radially inwardly extending portion 76 of an aft end of the inner cover axially extending section 65B comes into close proximity with the rotor 132. The close proximity between the second portion 76 and the rotor 132 defines a second flow path $FP_2$, an axially downstream flow path, having a reduced radial dimension, between the inner cover axially extending section 65B and the rotor 132. However, a small amount of cooling air in the second gap $G_2$ is permitted to flow through the second flow path $FP_2$ and into a cooling cavity 78, which cooling cavity 78 is formed between the rotor cover assembly 20 and the first row blade assembly 132A.

Rotor cooling air inlet apertures 80 define inlets for cooling air from the second gap $G_2$ to pass into one or more passageways 81 formed in the rotor 132, see FIG. 2. The cooling air flows through the one or more passageways 81 to structure to be cooled within the turbine section 130, including the first row blade assembly 132A, as shown in FIG. 2.

Referring to FIGS. 2 and 3, the radially outwardly extending section 65A of the inner cover 28 includes a plurality of apertures 82. The apertures 82 are radially and circumferentially aligned with the apertures 62 formed in the radially extending section 60 of the outer cover second portion 32, such that each bolt 64 can be inserted through a set of corresponding apertures 62, 82. The apertures 82 may comprise threaded holes that have a radial opening $R_{O2}$, see FIG. 3, which is smaller than the radial openings $R_{O1}$ of the apertures 62 formed in the radially extending section 60 of the outer cover second portion 32. In the embodiment shown, the radial openings $R_{O2}$ are substantially the same size as the diameter $D_1$ of the bolts 64, such that the bolts 64 may be tightly secured in the threaded holes.

As most clearly shown in FIG. 3, one or more sealing structures 90 are disposed between the radially extending section 60 of the outer cover second portion 32 and the radially extending section 65A of the inner cover 28. The sealing structures 90 may comprise, for example, ceramic rope seals, W-seals, or O-rings, and substantially prevent cooling air in the first gap $G_1$ from escaping into a slot 92, see FIG. 3, between the section 60 of the outer cover second portion 32 and the radially extending section 65A of the inner cover 28, which cooling air in the slot 92 could otherwise leak into hot working gases passing through the turbine section 130. The sealing structures 90 also substantially prevent the working gases in a hot gas path $H_G$, see FIG. 2, from leaking into the slot 92 and then into the first gap $G_1$. It is understood that other types of sealing structures may be used between the radially extending section 60 of the outer cover second portion 32 and the radially extending section 65A of the inner cover 28 and may be disposed in other locations than that shown in FIGS. 2 and 3.

As shown in FIGS. 2 and 3, the cooling cavity 78 is formed between the section 65A of the inner cover 28 and the first row blade assembly 132A. Angel wings 101 extending from turbine blades 1132A defining the first row blade assembly 132A extend toward the radially extending section 65A of the inner cover 28 such that an axial distance between an annular lip 102, see FIG. 3, of the inner cover radially extending section 65A and each angel wing 101 is as small as possible without contact between the angel wings 101 and the annular lip 102 of the inner cover radially extending section 65A occurring. The turbine blades 1132A are coupled to a disc 1132B, which, in turn, is coupled to the rotor 132. Thus, leakage of cooling air from the cooling cavity 78 into the hot gas path $H_G$ and leakage of working gases in hot gas path $H_G$ into the cooling cavity 78 are minimized.

Referring to FIGS. 2 and 3, the flow directing duct annular exit 318 includes a radially inner edge 106 and a radially outer edge 108. The support structure 68 of the flow directing duct 310 extends radially inwardly from the inner edge 106 of the flow directing duct 310 toward the rotor 132. The support structure 68 includes a plurality of apertures 113 formed therein that are radially and circumferentially aligned with the apertures 62, 82 of the radially extending section 60 of the outer cover second portion 32 and the radially outwardly extending section 65A of the inner cover 28, such that the bolts 64 can be inserted through all of the corresponding apertures 62, 82, 113. The apertures 113 comprise radial openings $R_{O3}$, see FIG. 3, which are smaller than the radial openings $R_{O1}$ of the apertures 62 of the radially extending section 60 of the outer cover second portion 32, and, in a preferred embodiment, are substantially the same size as the radial openings $R_{O2}$ of the apertures 82 of the radially outwardly extending section 65A of the inner cover 28, such that a tight fit is formed between the radially extending section 60 of the outer cover second portion 32, the structure 68, the radially outwardly extending section 65A of the inner cover 28, and the bolts 64.

The arrangement of the bolts 64 within the respective apertures 62, 82, 113 formed in the radially extending section 60 of the outer cover second portion 32, the radially outwardly extending section 65A of the inner cover 28 and the flow directing duct support structure 68, respectively, permits relative radial movement of the outer cover 27 with respect to the bolts 64, the inner cover 28 and the flow directing duct support structure 68. That is, since the radial openings $R_{O1}$ of the apertures 62 are oversized, the outer cover 27 is permitted to move radially inwardly and radially outwardly a small amount with respect to the bolts 64, the inner cover 28, and the flow directing duct support structure 68.

Figure 4:
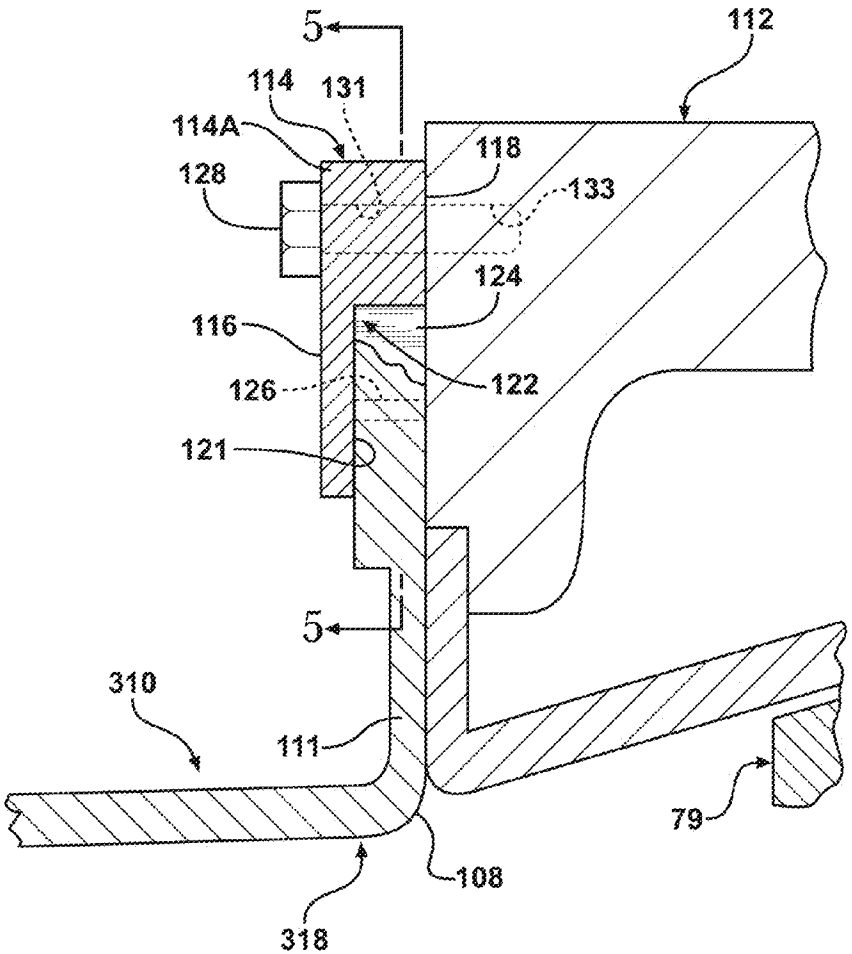
FIG. 4 is an enlarged perspective view partially in section illustrating an attachment of a flow directing duct to a vane carrier included in the transition section shown in FIG. 2.

Referring to FIG. 4, the flow directing duct 310 includes a lip 111 that extends radially outwardly from the outer edge 108 of the flow directing duct annular exit 318. The lip 111 is fixed to a vane carrier structure 112 via a plurality of mounting structures 114, which vane carrier structure 112 also supports the second, third and fourth stationary row vane assemblies 134A-134C. The vane carrier structure 112 is fixedly mounted to the engine casing 36, as shown in FIG. 2, and assists in mounting the cover assembly 20 within the engine. Each mounting structure 114 includes a forward surface 116 that faces axially upstream and opposed first and second aft surfaces 118, 121 that face axially downstream. The first and second aft surfaces 118, 121 are axially offset, wherein the first aft surface 118 abuts the vane carrier structure 112 and an axial slot 122 is formed between the second aft surface 121 and the vane carrier structure 112.

A protuberance 124 extends axially downstream from the second aft surface 121, i.e., to an axial location between the axial locations of the first and second aft surfaces 118, 121. The protuberance 124 may extend to substantially the same axial location as that of the first aft surface 118, as shown in FIG. 4. In the embodiment shown, the protuberance 124 includes a circumferential width $W_1$, see FIG. 5, that is less that a circumferential width $W_2$ of a main body 114A of the mounting structure 114, such that the slot 122 encompasses areas on both circumferential sides of the protuberance 124.

Figure 5:
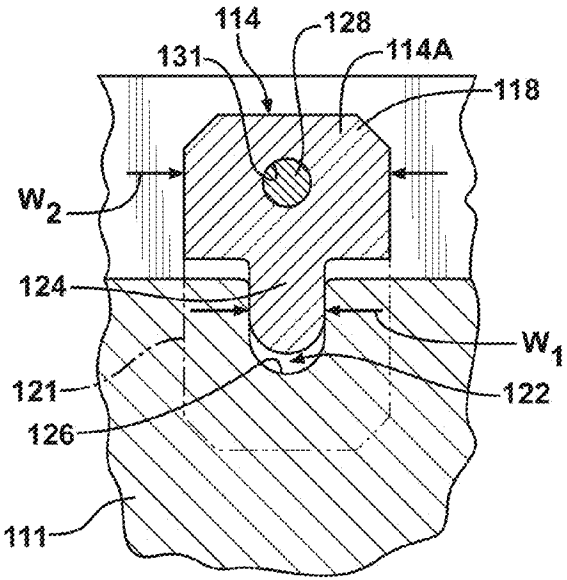
FIG. 5 is a cross sectional view taken along line 5-5 in FIG. 4.

The lip 111 of the flow directing duct 310 is positioned in the slot 122 between the vane carrier structure 112 and the second aft surface 121, such that notches 126, see FIGS. 4 and 5, formed in the lip 111, receive the protuberances 124 of the mounting structures 114. Fasteners, e.g., bolts 128, are then inserted through corresponding holes 131, 133 formed in the mounting structure main bodies 114A and the vane carrier structure 112, respectively, to secure the flow directing duct lip 111 in place. This arrangement allows for relative radial movement between the cover assembly 20 and the vane carrier structure 112, while axially and circumferentially securing the cover assembly 20 to the vane carrier structure 112, as will be described in detail herein. That is, the lip 111 of the flow directing duct 310 may slide radially outwardly within the slot 122 until the lip 111 contacts the main body 114A and/or the protuberance 124 of the mounting structure 114.

During operation of the engine, the hot working gases from the combustion apparatuses 200 are directed into and through the flow directing duct 310 and are released at the annular exit 318, i.e., between the inner and outer edges 68, 108, into the turbine section 130. The working gases flow through the hot gas path $H_G$ where the working gases are expanded and cause the first, second, third and fourth axially spaced apart row blade assemblies 132A-132D to effect rotation of the rotor 132. Due to temperature differentials between the compressor air, the hot working gases, the cooling air, etc., the temperatures of the components of the combustor section 110 can be quite different, thus creating different amounts of thermal expansion of the components.

For example, the radially outer surfaces 77, 50 of the first and second portions 30, 32 of the outer cover 27 are exposed to compressor air, which compressor air is substantially hotter than the cooling air from the cooling means, i.e., about 600° F. for the compressor air as opposed to between about 250-350° F. for the cooling air, as noted above. Thus, the outer cover 27 is substantially hotter than the inner cover 28, which is substantially surrounded by the cooling air in the first and second gaps $G_1$, $G_2$. The outer cover 27 therefore is believed to experience a larger amount of thermal expansion than the inner cover 28. Since the rotor 132 is maintained at relatively cooler temperatures, i.e., due to its exposure to the cooling air from the cooling air feed tubes 55 that flows from the first gap $G_1$ into the second gap $G_2$, the rotor 132 is believed to experience a reduced amount of thermal expansion, as compared to a situation wherein the rotor 132 is not exposed to cooling air but is exposed to the air exiting the compressor section 120. Thus, the inner cover 28 is a better thermal match with the rotor 132 than the outer cover 27, i.e., the temperature of the rotor 132 is closer to the temperature of the inner cover 28 than to the temperature of the outer cover 27 as a result of the rotor 132 and the inner cover 28 being exposed to the cooling air. The close thermal match between the inner cover 28 and the rotor 132 allows for close placement of the inner cover 28 to the rotor 132 with a low risk of contact therebetween, which contact is desired to be avoided. Thus, an amount of cooling air that flows through the second flow path $F_{P2}$ into the cooling cavity 78 is reduced, therefore reducing the amount of cooling air that can leak into the hot gas path $H_G$ from the cooling cavity 78.

Additionally, since the inner cover 28 is substantially entirely surrounded by cooling air from the cooling air feed tubes 55, i.e., from the cooling air in the first and second gaps $G_1$, $G_2$, the inner cover 28 is permitted to be located in close proximity to the blade angel wings 101. Specifically, since thermal expansion of the inner cover 28 is reduced, radial thermal growth of the inner cover 28 relative the angel wings 101 is reduced, such that contact therebetween is substantially prevented even when the inner cover 28 is located close to the angel wings 101. The placement of the inner cover 28 close to the blade angel wings 101 reduces the distance therebetween, which reduces leakage between the hot gas path $H_G$ and the cooling cavity 78.

As mentioned above, the relatively larger size of the radial openings $R_{O1}$ of the apertures 62 formed in the radially extending section 60 of the outer cover second portion 32 permit the outer cover 27 to move radially independently from the bolts 64, the inner cover 28, and the flow directing duct 310. Specifically, the outer cover 27 is permitted to move radially inwardly and outwardly relative to the bolts 64, the inner cover 28, and the flow directing duct 310, until the bolts 64 contact the respective lower or upper surfaces defining the apertures 62 in the outer cover second portion 32. Accordingly, the size of the radial openings $R_{O1}$ of the apertures 62 dictates how far the outer cover 27 is permitted to move radially relative to the bolts 64, the inner cover 28, and the flow directing duct 310. This relative radial movement is believed to accommodate differences in radial thermal expansion between the outer and inner covers 27, 28, i.e., the outer cover 27 will expand radially a greater amount than the inner cover 28 due to the outer cover 27 being exposed to hot working gases, which will allow the inner cover 28 to be located more closely to the rotor 132 while reducing the risk of contact therebetween.

It is noted that, since the radially outwardly extending section 60 of the outer cover 27 is axially coupled to the radially outwardly extending section 65A of the inner cover 28, i.e., via the bolts 64, the radially outwardly extending sections 60, 65A of respective covers 27, 28 do not move axially with respect to one another. However, as noted above, the notch 47A defined by the outer cover first and second portions 30, 32 may be slightly oversized in the axial direction with respect to the radial rib 47 of the inner cover 27. Thus, the outer cover 27 may be permitted to move axially slightly with respect to the forward end 71 of the inner cover 28, i.e., to accommodate differences in thermal growth between the outer and inner covers 27, 28.

Additionally, the attachment of the rotor cover assembly 20 to the case mounting structure 46 permits the cover assembly 20 and the mounting structure 46 to move axially relative to one another a small amount. Specifically, the connection of the outer cover 27 to the case mounting structure using the coupling structures 48, in combination with the positioning of the casing mounting structure cylindrical base 46A within the recess 49 defined by the outer cover first and second portions 30 and 32, allows the cover assembly 20 to displace axially with respect to the case mounting structure 46, and thus move axially independently from the engine casing 36. However, the disposal of the case mounting structure support members 52 in the axially oversized apertures 54 in the outer cover second portion 32 permits the outer cover second portion 32 and the case mounting structure 46 to move axially relative to one another a small amount before the outer cover second portion 32 and the support members 52 engage one another and, hence, prevents the cover assembly 20 from axially sliding too far relative to the case mounting structure 46 and the engine casing 36 or vice versa. The ability of the cover assembly 20 and the engine casing 36 to move axially relative to one another allows the cover assembly 20, i.e., the inner cover 28, to be closely located to the angel wings 101 without a high risk of contact therebetween, which reduces leakage between the hot gas path $H_G$ and the cooling cavity 78. Specifically, since the engine casing 36 is free to move axially with respect to the cover assembly 20 a small amount and vice versa, thermal expansion of the engine casing 36 will not cause a corresponding axial movement of the cover assembly 20 toward the first row of blades 79.

Moreover, the attachment of the lip 111 of the flow directing duct 310 to the vane carrier structure 112 facilitated by the mounting structures 114 permits the cover assembly 20 to move axially and circumferentially with the vane carrier structure 112, while allowing the cover assembly 20 to move radially independently from the vane carrier structure 112. Specifically, the lip 111 may slide radially on the second aft surface 121, but is axially held in place by the second aft surface 121 and the vane carrier structure 112 within the slot 122, and circumferentially held by the insertion of the protuberances 124 into the lip notches 126. This relative radial movement is believed to accommodate differences in thermal expansion between the vane carrier structure/engine casing and the cover assembly 20, which will allow the inner cover 28 to be located more closely to the rotor 132 while reducing the risk of contact therebetween, as the cover assembly 20 is permitted to move radially a small amount relative to the vane carrier structure/engine casing at the connection of the flow directing duct 310 to the vane carrier structure 112.

It is understood that traditional transition ducts and separate first vane members can be used in the place of the flow directing duct 310 without departing from the spirit and scope of the invention. Specifically, if traditional transition ducts and separate first vane members are used in the place of the flow directing duct 310, the separate first vane members would be affixed to the outer and inner covers 27, 28, i.e., via the bolts 64, in the place of the flow directing duct 310. The separate first vane members would also be supported by the vane carrier 112, i.e., via the mounting structures 114, in the place of the flow directing duct 310. During operation, the transition ducts would discharge the working gases from the respective combustion apparatuses 200 substantially axially toward the separate first vane members, which separate first vane members would alter the direction of the working gases in a traditional manner. The remaining structures described herein remain the same.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cover assembly disposed about a rotor in a gas turbine engine comprising:

a first cover disposed about the rotor and comprising a forward end and an opposed aft end, said first cover associated with a case mounting structure that is fixed to an engine casing;

a second cover disposed about the rotor and comprising a forward end and an opposed aft end, at least a portion of said first cover disposed radially outwardly from said second cover such that a first gap is formed between said first and second covers, said first gap receiving cooling air that cools said first and second covers;

at least one sealing structure between said first and second covers, said sealing structure limiting leakage between said first gap and a hot gas path associated with a turbine section of the engine; and securing structure that couples said first cover to said second cover, said securing structure permitting relative radial movement between said first and second covers.

2. The cover assembly according to claim 1, further comprising a flow directing duct adapted to alter a direction of working gases flowing between a combustor section of the engine and the turbine section of the engine.

3. The cover assembly according to claim 2, wherein said flow directing duct is coupled to said first and second covers via said securing structure, and wherein said first cover is movable radially independently of said second cover and said flow directing duct.

4. The cover assembly according to claim 3, wherein said first cover, said second cover, and said flow directing duct are movable axially substantially together.

5. The cover assembly according to claim 2, wherein said flow directing duct is mounted to a vane carrier structure such that said flow directing duct is movable radially independently of said vane carrier structure and is movable axially with said vane carrier structure, said vane carrier structure mounted to said engine casing.

6. The cover assembly according to claim 1, wherein said securing structure comprises a plurality of bolts, and wherein a plurality of apertures are formed in a radially extending section of said first cover that receive said bolts, said apertures comprising radial openings that are larger than diameters of corresponding ones of said bolts such that said first cover is permitted to move radially with respect to said bolts.

7. The cover assembly according to claim 1, wherein said second cover includes at least one bore formed therein, at least a portion of said cooling air in said first gap passes through said bore into a second gap between said second cover and the rotor, said cooling air in said second gap cools said second cover and the rotor.

8. A cover assembly disposed about a rotor in a gas turbine engine comprising:

a first cover disposed about the rotor and comprising a forward end and an opposed aft end, said first cover associated with a case mounting structure that is mounted to an engine casing;

first coupling structure that couples said first cover to said case mounting structure such that said first cover can move axially independently from said case mounting structure and said engine casing;

a second cover disposed about the rotor and comprising a forward end and an opposed aft end, at least a portion of said first cover disposed radially outwardly from said second cover such that a first gap is formed between said first and second covers, said first gap receiving cooling air that cools said first and second covers; and at least one sealing structure between said first and second covers, said sealing structure limiting leakage between said first gap and a hot gas path associated with a turbine section of the engine.

9. The cover assembly according to claim 8, wherein said second cover is coupled to said first cover such that said first and second covers move axially together and can move radially independent of each other.

10. The cover assembly according to claim 9, further comprising a flow directing duct adapted to alter a direction of working gases flowing between a combustion section of the engine and a turbine section of the engine.

11. The cover assembly according to claim 10, wherein said flow directing duct is coupled to said first and second covers, and wherein said first cover is movable radially independently of said second cover and said flow directing duct, and wherein said first cover, said second cover, and said flow directing duct are movable axially substantially together.

12. The cover assembly according to claim 11, wherein said flow directing duct is mounted to a vane carrier structure such that said flow directing duct is movable radially independently of said vane carrier structure, said vane carrier structure mounted to said engine casing.

13. The cover assembly according to claim 9, further comprising securing structure to couple said first cover to said second cover, wherein a plurality of apertures are formed in a radially extending section of said first cover that receive said securing structure, said apertures comprising radial openings that are larger than diameters of corresponding ones of said securing structures such that said first cover is permitted to move radially with respect to said securing structures.

14. A cover assembly disposed about a rotor in a gas turbine engine comprising:

a first cover disposed about the rotor and comprising a forward end and an opposed aft end, said first cover associated with a case mounting structure that is fixed to an engine casing;

a second cover disposed about the rotor and comprising a forward end and an opposed aft end, at least a portion of said first cover disposed radially outwardly from said second cover such that a first gap is formed between said first and second covers, said first gap receiving cooling air that cools said first and second covers, wherein said second cover includes at least one bore formed therein, at least a portion of said cooling air in said first gap passes through said bore into a second gap between said second cover and the rotor, said cooling air in said second gap cools said second cover and the rotor; and securing structure that couples said first cover to said second cover, said securing structure permitting relative radial movement between said first and second covers.

15. The cover assembly according to claim 14, wherein said second cover is coupled to said first cover such that said first and second covers move axially together.

16. The cover assembly according to claim 14, further comprising a flow directing duct adapted to alter a direction of working gases flowing between a combustor section of the engine and the turbine section of the engine.

17. The cover assembly according to claim 16, wherein said flow directing duct is coupled to said first and second covers via said securing structure, and wherein said first cover is movable radially independently of said second cover and said flow directing duct.

18. The cover assembly according to claim 17, wherein said first cover, said second cover, and said flow directing duct are movable axially substantially together.

19. The cover assembly according to claim 16, wherein said flow directing duct is mounted to a vane carrier structure such that said flow directing duct is movable radially independently of said vane carrier structure and is movable axially with said vane carrier structure, said vane carrier structure mounted to said engine casing.

20. The cover assembly according to claim 14, wherein said securing structure comprises a plurality of bolts, and wherein a plurality of apertures are formed in a radially extending section of said first cover that receive said bolts, said apertures comprising radial openings that are larger than diameters of corresponding ones of said bolts such that said first cover is permitted to move radially with respect to said bolts.

* * * * *